United States Patent [19]

Bebie

[11] Patent Number: 4,536,625

[45] Date of Patent: Aug. 20, 1985

[54] KEYBOARD DESIGN

[76] Inventor: Alain M. Bebie, Germaniastr. 51, 8006, Zurich, Switzerland

[21] Appl. No.: 599,801

[22] Filed: Apr. 13, 1984

[30] Foreign Application Priority Data

Apr. 20, 1983 [CH] Switzerland ..... 2105/83
Oct. 11, 1983 [CH] Switzerland ..... 5521/83
Nov. 14, 1983 [CH] Switzerland ..... 6100/83

[51] Int. Cl.[3] ..... H01H 13/70

[52] U.S. Cl. ..... 200/5 A; 200/6 A; 200/159 B; 200/339

[58] Field of Search ..... 200/5 R, 5 A, 6 A, 86 R, 200/159 B, 302.2, 314, 339, 302.1, 160

[56] References Cited

U.S. PATENT DOCUMENTS 3,728,509 4/1973 Shimojo ..... 200/159 B
3,760,137 9/1973 Shimojo et al. ..... 200/5 A X
3,898,421 8/1975 Suzumura ..... 200/5 A X
3,917,917 11/1975 Murata ..... 200/302.2 X
3,930,083 12/1975 Pinkham ..... 200/5 A X
3,932,722 1/1976 Opata et al. ..... 200/5 A X
4,066,860 1/1978 Kawasaki ..... 200/159 B X
4,109,118 8/1978 Kley ..... 200/5 R
4,127,758 11/1978 Lowthorp ..... 200/5 A X
4,216,968 8/1980 Yeeda ..... 200/5 A X
4,231,098 10/1980 Tanimoto ..... 200/5 A X
4,286,129 8/1981 Petit ..... 200/159 B
4,289,940 9/1981 Sado et al. ..... 200/5 A
4,289,943 9/1981 Sado ..... 200/160 X
4,302,648 11/1981 Sado et al. ..... 200/5 A X
4,347,504 8/1982 Murofushi et al. ..... 200/5 A X
4,376,238 3/1983 Martin ..... 200/5 A X
4,408,103 10/1983 Smith, III ..... 200/6 A

FOREIGN PATENT DOCUMENTS 1259356 1/1972 United Kingdom ..... 200/339

*Primary Examiner*—J. R. Scott
*Attorney, Agent, or Firm*—Carroll F. Palmer

[57] ABSTRACT

Electrical switch keyboards comprise a one-piece mat made of resilient material laid in sealing engagement upon a frame within which switching elements are positioned to operate in conjunction with key portions of the mat. The mat is the uppermost layer of the keyboard and comprises the key portions connected by integral spring portions to frame positioning portions. Operation elements carried on integral extensions depending from the key portions of the mat function with the switching elements in the frame to produce switching currents upon actuation of the key portions.

24 Claims, 40 Drawing Figures

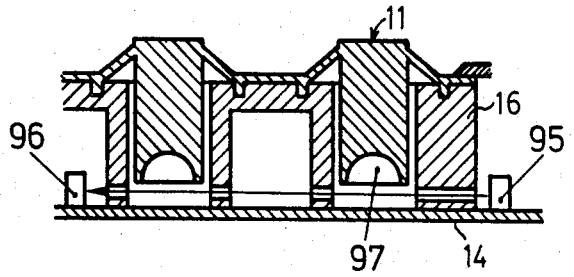
FIG. 29
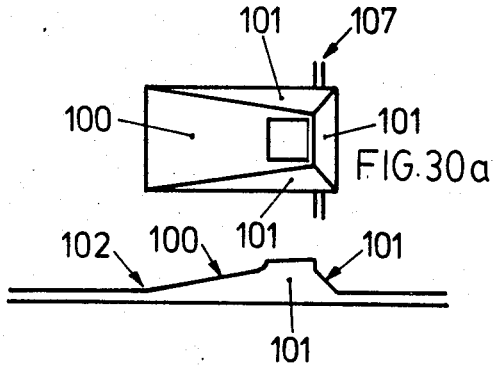
FIG. 30a
FIG. 30b
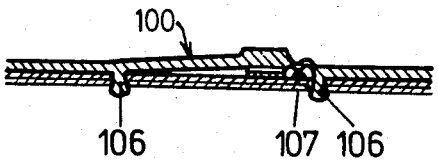
FIG. 32
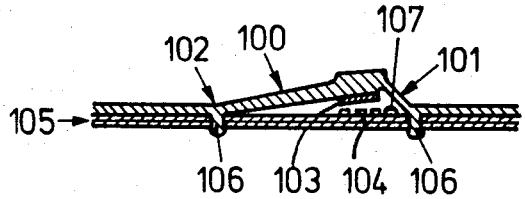
FIG. 31
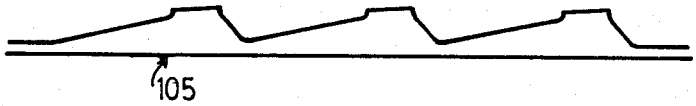
FIG. 33
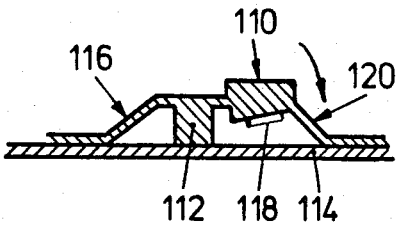
FIG. 34

KEYBOARD DESIGN

BACKGROUND OF THE INVENTION

1. Field of the Invention

This invention broadly relates to electrical switch keyboards. More particularly, it concerns switch keyboards having a one-piece resilient sheet over a frame with switch elements on the frame side of the sheet so the sheet seals the entire device against any intrusion of dirt, moisture, etc. into the keyboard.

2. Description of the Prior Art

Switch keyboards are known in which keys are arranged on a frame and there is a mat so designed that, when viewed from the operating side of the keyboard, the mat covers the frame so completely that only the keys are left uncovered. For assembly, the mat is basically clamped between a first piece of the frame which contains the switch devices and a cover as a second part having corresponding openings for the keys of the switch devices. Such prior keyboards have the disadvantage of having empty spaces between the cover with the opening for the keys and the mat since dirt can gather in such spaces and cleaning away the dirt is difficult.

Other keyboard designs are known in which a resilient mat is a final coating for the frame. Such keyboards either have additional spring mechanisms and/or the keys are not guided in their reciprocation movement so that, on actuation of the keys, guidance of the keys may not be precise and there is a lack of tactile feeling by the operator of switch operation.

OBJECTS

A principal object of this invention is the provision of electrical switch keyboards of new design.

Further objects include the provision of such keyboards:

1. In which their switch elements are sealed against intrusion of dirt or like foreign matter.

2. In which a sealing mat is the outside cover of the frame and associated parts.

3. Having a sealing mat that includes key portions and portions for the positioning of the mat on the frame plus spring portions which provide spring action for the key portions.

4. In which the keys are guided in their movement so that reliable switching of the switch elements consistently occurs.

5. Wherein at each key field there is at least one switching element so that the key fields act directly as parts of the switch keyboards.

6. That are very simple in construction, reliable in operation and effective in protecting their switch elements against any intrusion.

7. Wherein an operator thereof obtains a feedback to indicate whether the actuation of a key has resulted in the switching of a signal or not.

8. That have raised keys on the operational side to stand out in relation to the plane of the protective mat.

9. In which a protective mat can be easily replaced, if, for example, at a data entry terminal the marking of the key portions need to be changed to suit differing operations or programs, different mats corresponding to these programs can be put in place.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of electrical switch keyboards comprising a one-piece resilient mat laid over a frame in which switching elements are positioned to move in conjunction with the mat for their operation and wherein the mat is the final outer layer of the frame. The mat comprises key portions, spring portions and positioning portions with each key portion being connected to a spring portion and to a positioning portion.

In preferred embodiments of the invention:

a. each key portion comprises at least one operation element for signal generation, b. the contact portion of the switch elements is formed of conductive, resilient material such as conductive silicone rubber, c. the resilient mat and the switch key portions are made of identical material, d. spring portions of the resilient mat are so designed that at actuation of the key portions of the mat toward the frame a snap action occurs, e. in a cross section of the mat, the key portions thereof are elevated coaxially away from the frame either normal to or at an angle to the plane of the resilient mat, f. the spring portions of the mat are curved in a concave fashion towards the frame and when in the released position are pre-stretched by stretching means on the frame, g. the spring portions surround only a part of the key portions h. the key portions have either positive guides or negative guides and the frame has corresponding guide surfaces, i. the key portions have piston-like extensions normal to the plane of the frame, preferably with a central hole and the frame has corresponding cylindrical guides and/or pin guides.

j. the key portions each have at least two switch elements that have varying switching modes, in which the switching mode corresponds to the operational travel of the key portion.

k. different contact carrying devices can either be attached or detached from the frame on its side opposite to the resilient mat, l. key portions of the mat are shaped like joy sticks and can be tilted so that at least one contact is brought into signal generation position.

BRIEF DESCRIPTION OF THE DRAWINGS

A more complete understanding of the invention may be obtained by reference to the accompanying drawings in which:

FIGS. 23 to 29 are lateral, fragmentary, cross-sectional views through other embodiments of keyboard designs of the invention.

FIG. 30 shows a plan view and a lateral view of a key portion of a resilient mat according to the invention, where the key portion at actuation produces sidewise tilting.

FIGS. 31 & 32 are fragmentary, lateral sectional views of the design shown in FIG. 30 in released and actuated position.

FIG. 33 is a lateral view similar to FIG. 30 showing several key portions.

FIG. 34 is a fragmentary, lateral view of another design variation similar to that shown in FIG. 30.

DESCRIPTION OF PREFERRED EMBODIMENTS

Figure 1:
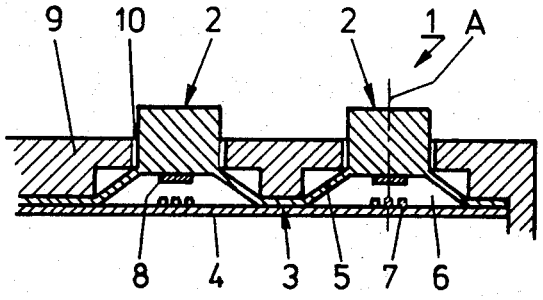
FIG. 1 is lateral, cross-sectional view through a keyboard design of the prior art.

With reference in detail to the drawings, a form of keyboard design of prior known type is shown in FIG. 1. The design comprises a preformed mat 1 made of resilient material with key areas 2 and positioning areas 3. Mat 1 lies on the side of device on a board 4. The profile of the mat 1 produces, as seen in FIG. 1, coaxial elevated key areas 2 with relation to the axis A normal to the plane of the board 4. The key areas 2 are connected through spring parts 5 to the positioning areas 3. This gives each key area 2 a cavity 6 which can be compressed. Electrical contacts 7 are in cavities 6 on the board 4 which function together with the contact elements 8 on the key areas 2. The mat 1 is covered by a cover 9, which gives more or less guidance to the movement of the key areas 2 in their movement along the axis A. The cover 9 has holes 10 through which the key areas 2 protrude. The fissures and cavities between the cover 9 and the mat 1 can accumulate dirt and are very difficult to clean.

Figure 2:
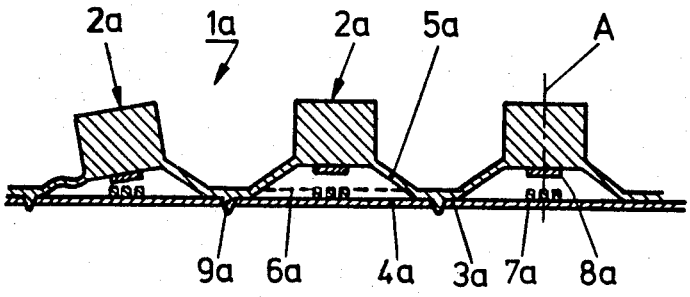
FIG. 2 is a lateral, fragmentary, cross-sectional view through a first embodiment of a keyboard design of the invention.

FIG. 2 shows a first embodiment of keyboard design in accordance with the invention, which still has certain disadvantages as compared to the preferred embodiments of keyboards of the invention. This embodiment comprises a mat 1*a*, made of resilient material with positioning portions 3*a* fixed to a board 4*a* and with key portions 2*a*. The positioning portions 3*a* are connected to the key portions 2*a* through spring portions 5*a* in such manner that gaps 6*a* are formed between the key portions 2*a* and the board 4*a*. Contacts 7*a* are on the board in the gaps 6*a* and contacts 8*a* are on the key portions 2*a*.

The difference between the prior design of FIG. 1 and the design of FIG. 2 is that there are no frame parts or cover on the operating side of the keyboard surrounding the key portions 2*a* where dirt could accumulate without the possibility of easy cleaning plus manufacturing cost of the design of FIG. 2 can be reduced in comparison to the design of FIG. 1.

The mat 1*a* can be designed for easy replacement, e.g., it can be mounted with pins 9*a* that snap into the board 4*a*.

A disadvantage of the first embodiment of FIG. 2 is that, as shown on the left side key portion 2*a*, the key portion can, under a sidewise force, tilt to on side which can result in uncertain contact between contact points 7*a* and 8*a*. However, this tilting aspect is used in certain embodiments of the invention to selectively attain different switching positions with the same key.

Figure 3:
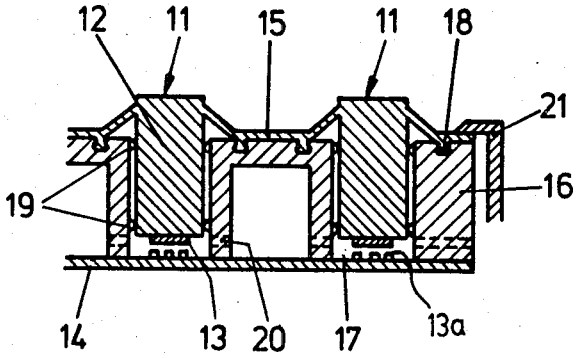
FIG. 3 is a lateral, fragmentary, cross-sectional view through a second embodiment of a keyboard design of the invention.

FIG. 3 and following figures show embodiments of the invention which have, in addition to the advantages of the embodiment of FIG. 2, a precise guidance for the movement of the key portions 11 of the mat 15 of the new keyboards. In these embodiments, the key portions 11 are provided with guidance pistons 12 in the direction of the frame base 14. The pistons 12, which have conductive elements 13 on their ends, are guided axially in the frame 16 to which the mat 15 is fixed by ribs or pins that can be inserted into the frame 16. The pistons 12 and the frame 16 form slide bearings 19 with small clearance and little friction between them. The bores 17 in which the pistons 12 move should not be sealed to one another since then operation of the key portions 11 will produce a pressure. Tunnels 20 between the bores 17 can prevent this. The same result can be obtained when all positioning portions of the mat 15 on the frame 16 do not seal between each other so that the entire mat structure can absorb the occurring pressure.

To insure the sealing between the mat 15 and the enclosure 21 of the new keyboards, the mat can be clamped at its edges and/or at the edges of the frame 16. In this way, the mat 11 and the frame or the frame and the enclosure form a hermetically sealed unit.

Figure 4:
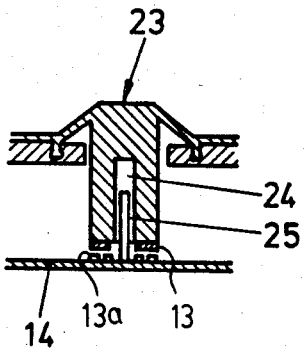
FIG. 4 is a lateral, fragmentary, cross-sectional view through a third embodiment of a keyboard design of the invention.

Another guidance variation is shown in FIG. 4. Here, on the underside of the key portion 23 there is a piston-like extension which is not guided peripherally in an opposing structure, but in its axial center. For this, the extension of the key portion has a coaxial bore 24 into which a projection 25 from the frame base 14 extends.

Figure 5:
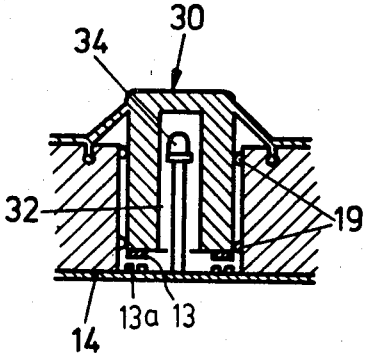
FIG. 5 is a lateral, fragmentary, cross-sectional view through a fourth embodiment of a keyboard design of the invention.

The entire mats, e.g. 15, 23 or any others described herein, including their related guidance pistons, can be made as one integral unit or they may be made as separate elements fixed together such as by adhesive or in other suitable fashion. Further, if the mat 23 is made of translucent silicone rubber, it is possible, as shown in FIG. 5, to have the piston part 30 of the mat be guided on the peripheral side 19 and have in a coaxial bore 32 a signal light 34, e.g., a light emitting diode. Also, instead of the contact areas 13 of FIG. 3, knobs may be placed on the base of the piston part 30 that serve to operate foil membrane switches (not shown). With piston parts on the key portions of the mats, it is also possible to activate optical switch systems by the interruption of optical signals on operation of the key portion.

Figure 6:
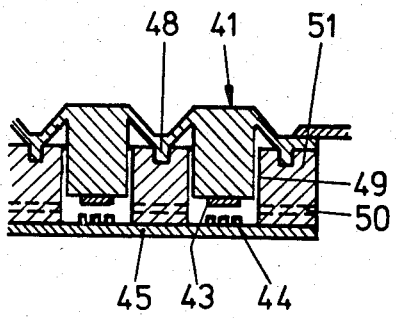
FIG. 6 is a lateral, fragmentary, cross-sectional view through a fifth embodiment of a keyboard design of the invention.

FIG. 6 illustrates embodiment of the new keyboards. It shows key portions 41 which have depending pistons for guidance in bores 49 of the frame 51. Contacts 43 are provided on the ends of the pistons which produce switching signals by forming a contact bridge between two contact points 44 on a printed circuit board 45. The mat is fixed to the frame by ribs 48 that are inserted into correspondingly shaped profiles in the frame 51. Tunnels 50 prevent, as previously mentioned, pressure building up under the mat upon operation of the key portions 41.

Figure 7:
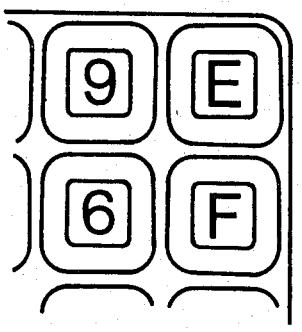
FIG. 7 is a fragmentary plan view of a marked keyboard of the invention.
Figure 8:
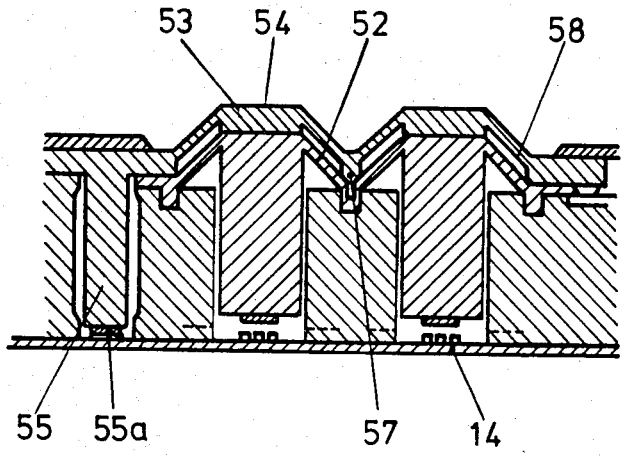
FIG. 8 is a lateral, fragmentary, cross-sectional view through a sixth embodiment of a keyboard design of the invention.

The key portions 11, etc., can have different shapes and are normally marked on the operating side as seen in FIG. 7. In order to change the indicia to accommodate changed data entry programs, the mats can be made interchangeable. If an exchange of the mat is not desired for cleaning or for marking change, a second mat 53 can be laid over mat 52 as shown in FIG. 8. The mat 53 is made of resilient material, e.g., silicone rubber, and is marked on areas 54 coincident with the key portions. Mat 53 can be either used solely as a marked mat to be placed on the switch mat 52 or it can act only as a marked switch mat. For the latter use as seen in FIG. 8, the covering mat 53 has downward pin extensions 55 with contact areas **55*a* which close two or more circuits on the board 14. Differently marked mats 53 for different entry programs can have the pins 55 at different places and close different circuits so that different mats 53 can select different programs of an EDP system or the system can verify whether the correct mat has been put in place for a specific program. The removable mats 53 can also be sealed to the surrounding equipment by a removeable sealing frame. Further, the contacts 55*a* can be placed just below the mat as shown on the right side of FIG. 8 and the mats 53 can have supplementary fixation snap-in pins or ribs 57. Finally, the identification contacts 55*a* can be applied directly to the mats 53, e.g., as with contacts 15 of FIG. 3**.

In the use of overlay mats, such as mats 53, an increase in the operational force must be taken into consideration. It can be useful to create a tunnel 58 or the like space to separate the mats 53 and 52, although this is not essential in every case depending on the materials and dimensions used.

Figure 9:
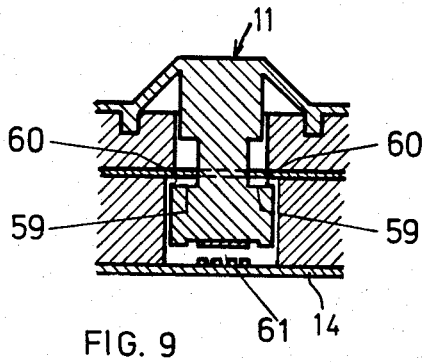
FIGS. 9 to 21 are lateral, fragmentary, cross-sectional views through other embodiments of keyboard designs of the invention.

In the embodiment of FIG. 9, at actuation of the key portions, the mat contact 59 moves away from the circuit board 60 which results in interruption of the electrical circuit. A closing contact 61 can be added to effect simultaneous on switching of another electrical circuit.

Figure 10:
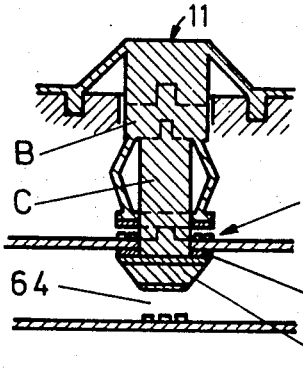
Figure 11:
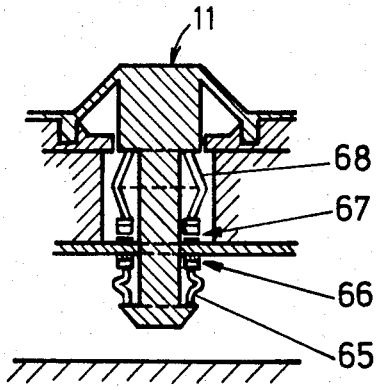

FIGS. 10 and 11 show further embodiments of closing and opening contacts where contacts make and brake in specific sequence. FIG. 10 shows how at actuation first a normally closed contact 62 opens, then, how a normally open contact 63 closes and, finally, how another normally open contact 64 is closed.

FIG. 11 shows an example of how normally open contact 67 is closed before the normally closed contact 66 is opened. In release position, the membrane profile is stretched in such a way that the corresponding contact 66 does not open until contact 67 closes. Such designs with additional spring parts with different tension in release position of the key portion, can also be used to influence the characteristics for operation force of the key portions. The membrane profile 65 of FIG. 11 can be designed to reduce required operational force and the profile 68 can be used to increase it.

Figure 12:
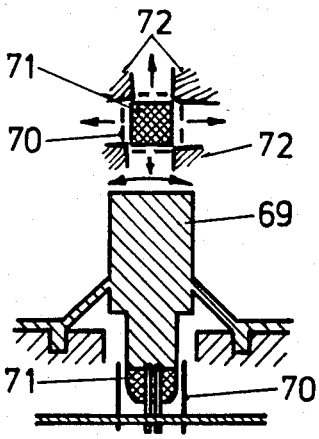

FIG. 12 shows a further variation of the basic design of the new keyboards. Here, a key portion extended toward the exterior of the device can be used as a joy stick 69 provided on its lower end with contact portion 71. The stick 69 can be moved in different directions. The layout of the contacts 70 as viewed from above appears at the top of FIG. 12. This shows that the contacts are selectively closed in the direction the stick is tilted. To guide movement of the stick 69, an additional guide pattern 72 can be used.

Figure 13:
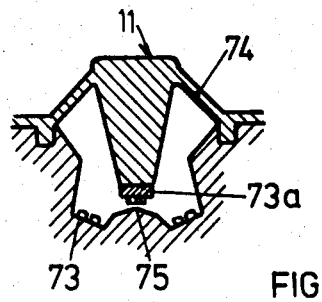
Figure 14:
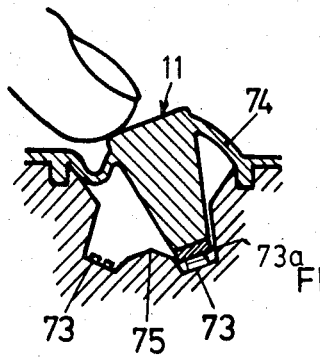
Figure 15:
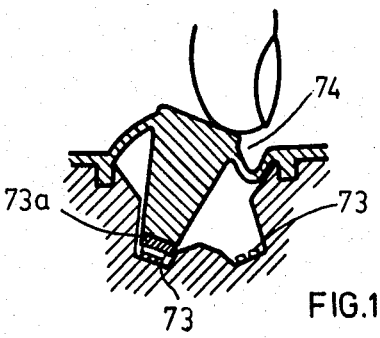

In the embodiment of FIG. 13, two or four switching positions per key portion 74 are provided in the frame 75 with corresponding switch contacts 73. According to the direction in which operational force is applied to the key portion 74, its inner extension bearing the contact **73*a* moves either forward, backward, right or left. Two switching positions are seen in FIGS. 14 & 15**.

Figure 16A:
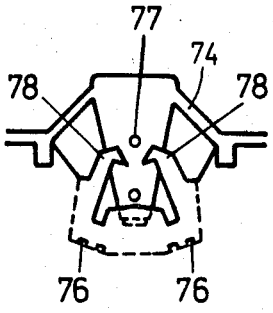
Figure 16B:
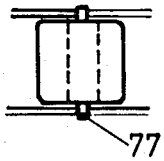
Figure 17:
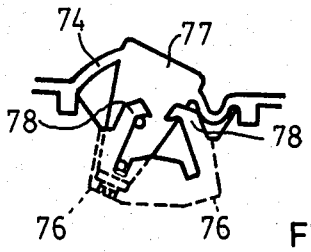
Figure 18:
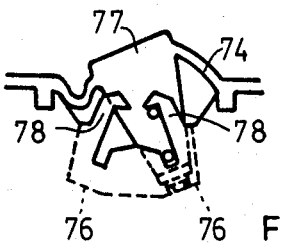

FIG. 16 shows a further embodiment in which the key portion 77 is tilted into contact positions 76, similar to those shown in FIG. 13. By sliding the key portion 77 under the blocking hooks 78, the key portion is retained in a contacting position (see FIGS. 17 & 18), but it can be released easily by light downward pressure in the opposite direction.

Figure 19:
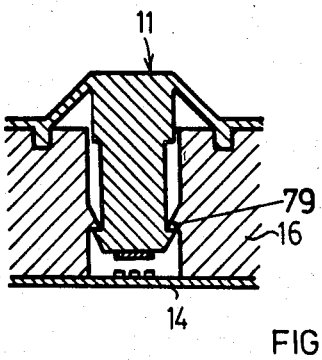
Figure 20:
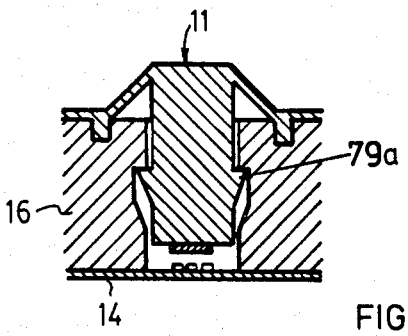

FIGS. 19 & 20 show how hooks 79 or ribs **79*a*** used to prevent the key portions from being pulled outwards when in the released position.

Figure 21:
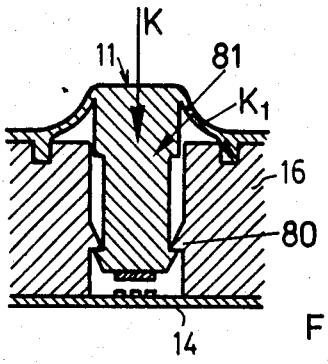

In FIG. 21, the hook 80 holds the the key portion slightly below the normal released position so that the spring portion 81 is already slightly deflected and stretched. The operational characteristics can be controlled by the pre-tension. A modification in the shape of the spring portion 81 as it appears in FIG. 21 can be specified at the time the mat is made.

Figure 22:
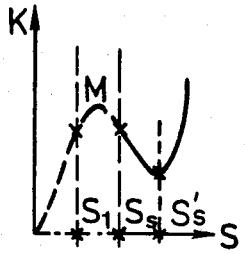
FIG. 22 is a diagram of actuation force in relation to actuation travel of a key of keyboards of the invention.

As shown in all embodiments of the new keyboards, the resilient mats always comprise key portions and positioning portions with integral spring portions there between. The spring portions in cross-section are structured so that the operation force first compresses the spring portion is its length in a least one component. The diagram in FIG. 22 indicates the result of this arrangement is that the operational force K first increases until operation position S is reached, goes through a maximum cycle and then decreases. The most favorable switching position immediately follows the maximum cycle M as shown by $S_s$ in FIG. 22.

Figure 23A:
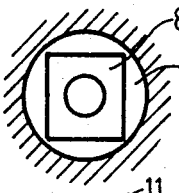
Figure 23B:
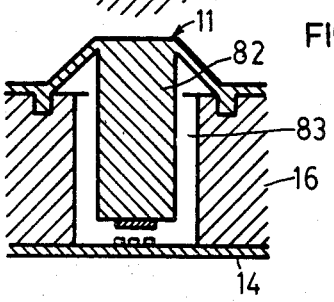

FIG. 23 shows a rectangular inner side extension of the key portion which runs in a round cylinder in the frame to reduce surface friction.

Figure 24:
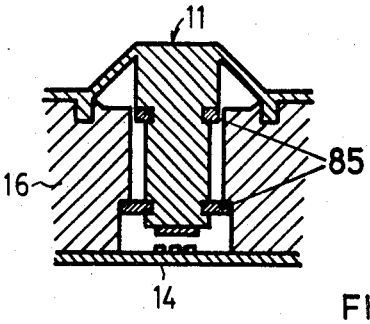

Added guide rings 85 as shown in FIG. 24 further reduce engagement between the key portion and the guides of the frame thereby decreasing the gliding friction. Also the rings 85 aid in retaining the key portion of the mat in its released position so that is can not be pulled outwards.

Figure 25:
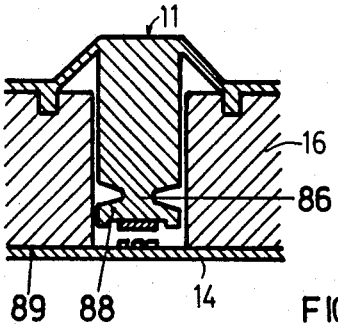
Figure 26A:
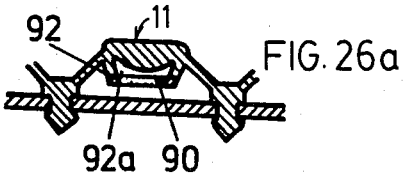
Figure 26B:
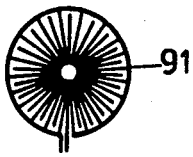
Figure 26D:
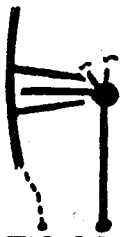
Figure 26C:
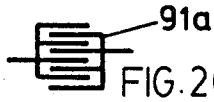

FIG. 25 shows an inner extension of the key portion with a narrowed section 86 to give flexibility to the contact area 87. This allows the contact 88 to adapt to the position of the opposite contact points on the circuit board 89.

FIG. 26 shows an embodiment designed to reduce the depth of the keyboard. The guide for the key portion 92 is only provided by the mat. In order to insure reliable switching even in a tilted position of the contact area 90 such area is made of ring shaped, soft material. The contacts 91 on the circuit board are in the form of a star shape or concentrical circles. The layouts of contacts **91*a* in conventional current use would not allow an insured short circuit depending on the position of the key contact area if actuated obliquely. The layout 91 of the circuit board contacts guarantees a proper circuit make even in a tilted position of the key contact area 90. The flexibility of area 90 is further increased by conical form of the key portion 92 and the cavity 92*a***.

Figure 27:
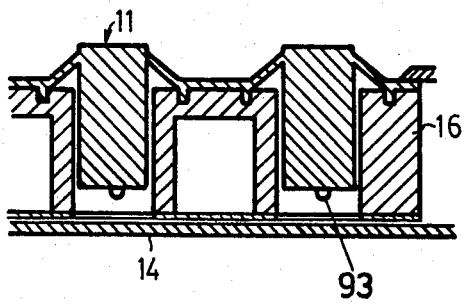
Figure 28:
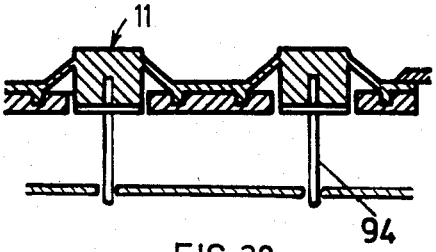

FIGS. 27 & 28 illustrate further embodiments. Foil membrane switches in current, general use make contact when an upper foil with a conductor is pressed onto a lower foil which has the counter contact. In the keyboards of the present invention, a knob 93 (FIG. 27) or a pin 94 (FIG. 28) at the inner end of the key portion allows for positive operation of foil membrane switches carried by the base portion of the keyboard frame.

FIG. 29 shows an example of an optical switch in an optoelectrical system. Optical emitters 95 and sensors 96 are placed under the key portions of the keyboard mat, e.g., in a matrix layout, so the the operation of a key portion interrupts a light beam connection. The extensions of the key portions can have a lower end cavity 97 to give the keys a soft end structure by deflection of the resilient material around the cavity 97.

FIGS. 30 to 33 show embodiments where the profile of the mat is such that the key portions tilt in a specific way so that no further guides are necessary and the key contact area is guided precisely in its movement. As the figures show, the key portion comprises a stiff zone 100 and a flexible spring zone 101. FIG. 31 shows a cross section of this design in released position. FIG. 32 shows the same, but in the switching position. As FIG. 32 shows, the spring zone 101 is first compressed and then deformed in operation. The stiff zone 100 remains rigid and provides necessary guiding. A notch 102 between zones 100 and the positioning area acts as a hinge. In operation, switching occurs by engagement of the key contact area 103 with the contacts 104 on the board 105 to which the mat is held by the integral pins 106.

Variations are possible in that the hinge may be placed in the lower, rather than the upper part of the key portion 100 and the key portions can be shaped other than rectangular.

FIG. 32 shows pins or ribs 106 to hold the mat on the frame. The opening 107 serves to equalize pressure when the key is operated.

FIG. 33 is a lateral view of a mat with a plurality of key portions.

FIG. 34 shows a variation of the form of mat discussed with reference to FIGS. 30–33 wherein the key portion 110 of the mat 116 is supported via a relatively rigid bearing 112 on the frame 114. The bearings 112 also provide a desirable stabilization of the key movement upon actuation. When the key is operated, the key portion 116 tilts to the opposite side of the bearing 112 and the contact 118 engages a pair of contacts on the frame 114 to create a contact bridge between the two frame contacts. Also in this design, the mat spring portion 120 is compressed before deflection to provide the desired snap action.

The embodiments of the invention in which an exclusive property or privilege is claimed are defined as follows:

1. An electrical switch keyboard comprising:

a frame defining an upper surface plane, a one-piece mat made of resilient material laid in sealing engagement upon said frame, said mat being an upper layer of the keyboard with portions thereof positioned above said plane, key portions formed integrally in said mat structured to move relative to said frame along a designated axis angled relative to said upper surface plane, means in part integrally depending below said mat from said key portions to guide said key portions in said relative movement to said frame so that they can not appreciably tilt sidewise of said designated axis upon actuation by an operator for movement along said designated axis, and switching elements positioned within said frame to operate in conjunction with said key portions, each of said key portions having an operation element to function with said switching elements to produce switching currents upon depression of the respective key portion.

2. An electrical switch keyboard comprising:

a frame defining an upper surface plane, a one-piece mat made of resilient material laid in sealing engagement upon said frame, said mat being an upper layer of the keyboard with portions thereof positioned above said plane, key portions formed integrally in said mat structured to move relative to said frame along an axis substantially perpendicular to said upper surface plane, means to guide said key portions in said relative movement so that they can not tilt sidewise of said axis upon actuation by an operator, said guidance means comprising a piston-like element depending from each key portion and a structure in said frame which provides a slide track for said piston-like element to a switching position, switching elements positioned within said frame to operate in conjunction with said key portions, each said piston element having an operation member depending therefrom to function with said switching elements to produce switching currents upon depression of the respective key portion.

3. A keyboard of claim 2 wherein each said key portion comprises a spring portion biasing said key portion against said movement upon actuation by an operator.

4. A keyboard of claim 2 wherein said switching elements include electrical contacts carried on integral extensions depending from said key portions.

5. A keyboard of claim 2 wherein said operation member is made of conductive elastomeric material.

6. A keyboard of claim 5 wherein said elastomeric material is silicone rubber.

7. A keyboard of claim 5 wherein said mat is made of elastomeric material.

8. A keyboard of claim 3 wherein said spring portions of said mat are designed to produce a snap action upon said actuation of said key portions.

9. An electrical switch keyboard comprising:

a frame defining an upper surface plane, a one-piece mat made of resilient material laid in sealing engagement upon said frame, said mat being an upper layer of the keyboard with portions thereof positioned above said plane, key portions formed integrally in said mat with connected spring portions and frame positioning portions, said key portions being structured to move relative to said frame along an axis substantially perpendicular to said upper surface plane, means to guide said key portions in said relative movement so that they can not tilt sidewise of said axis upon actuation by an operator, and switching elements positioned within said frame to operate in conjunction with said key portions, each said key portion having an operation element depending therefrom to function with said switching elements to produce switching currents upon depression of the respective key portion.

10. The keyboard of claim 7 wherein said key portions are elevated coaxially around axis which are perpendicular to said upper surface plane.

11. The keyboard of claim 9 wherein said means to guide comprises a piston-like element depending from each key portion and a guidance portion in said frame to slideably receive each piston-like element.

12. A keyboard of claim 9 wherein said key portions are elevated above said positioning portions which are fixed to said frame.

13. A keyboard of claim 9 wherein said spring portions as viewed in cross section are straight and connect said key portions to said positioning portions at an angle.

14. A keyboard of claim 9 wherein said spring portions are concave toward said frame.

15. A keyboard of claim 9 wherein said designated axis is perpendicular to said upper surface plane.

16. A keyboard of claim 9 wherein said spring portions completely surround said key portions.

17. A keyboard of claim 2 wherein said key portions include switching members that contact said switching elements in said frame.

18. A keyboard of claim 2 wherein said piston-like element has an axial bore therein surrounding a pin that is carried by said frame.

19. A keyboard of claim 2 wherein said mat comprises additional electrical contacts not designed to operate with said key portions but for connecting said mat to a mat identification circuit.

20. A keyboard of claim 11 wherein said piston element and said tubular portion each comprise ledges that engage in the upper movement of the respective key portion to fix an upper limit of upper movement of such key portion along said axis.

21. A keyboard of claim 2 having a second mat designed to overlay the aforesaid mat.

22. A keyboard of claim 2 wherein at least two switches with different contact positions along the movement of the key portions are positioned so that on actuation contacts are closed or opened in a sequence one after the other.

23. A keyboard of claim 2 wherein a second mat 53 having contact carrying parts 55 can be snapped on to key portions for easy exchange of specific functions for said keyboard.

24. A keyboard of claim 2 wherein hooks or ribs are used to prevent said key portions from being pulled out from said frame and thereby keep said mat attached to said frame.

* * * * *